US007104800B2

(12) United States Patent
Ortiz-Valero et al.

(10) Patent No.: US 7,104,800 B2
(45) Date of Patent: Sep. 12, 2006

(54) ARTICLE AND METHOD FOR SELECTION OF INDIVIDUALIZED PERSONAL CARE PRODUCTS

(75) Inventors: Carlos Ortiz-Valero, Hampton Bays, NY (US); John Depiano, Burlington, MA (US); Mark Dieter Dziersk, Winnetka, IL (US); Miles Hugh Eddowes, Edgewater, NJ (US); Gail Eileen Gibford, New York, NY (US); Christine Elizabeth Kennedy, Torrington, CT (US); Anthony Pannozzo, Brookline, MA (US)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 380 days.

(21) Appl. No.: 10/337,466

(22) Filed: Jan. 7, 2003

(65) Prior Publication Data

US 2004/0131996 A1 Jul. 8, 2004

(51) Int. Cl.
*G09B 25/00* (2006.01)

(52) U.S. Cl. ..... 434/371; 434/377; 434/371; 434/99; 434/100

(58) Field of Classification Search ..... 434/94, 434/99, 100, 377, 371
See application file for complete search history.

(56) References Cited

U.S. PATENT DOCUMENTS

| | | | | |
|---|---|---|---|---|
| 3,851,656 A | | 12/1974 | Tarro | |
| 4,072,314 A | * | 2/1978 | Rosen et al. | 273/161 |
| 4,434,467 A | | 2/1984 | Scott | |
| 4,630,904 A | * | 12/1986 | Pastore | 359/636 |
| 4,655,563 A | * | 4/1987 | Plante et al. | 359/849 |
| 5,228,879 A | * | 7/1993 | Fromm | 446/219 |
| 5,585,874 A | * | 12/1996 | Wickes | 351/233 |
| 5,657,563 A | * | 8/1997 | Lane | 40/219 |
| 5,940,120 A | * | 8/1999 | Frankhouse et al. | 348/61 |
| 5,951,143 A | * | 9/1999 | Ginsberg | 362/140 |
| 6,152,551 A | * | 11/2000 | Annas | 312/224 |
| 6,719,565 B1 | * | 4/2004 | Saita et al. | 434/94 |
| 2002/0080494 A1 | | 6/2002 | Meine | |
| 2002/0175990 A1 | * | 11/2002 | Martino et al. | 348/14.08 |
| 2003/0063102 A1 | * | 4/2003 | Rubinstenn et al. | 345/619 |
| 2003/0064356 A1 | * | 4/2003 | Rubinstenn et al. | 434/377 |
| 2003/0065450 A1 | * | 4/2003 | Leprince | 702/19 |

(Continued)

FOREIGN PATENT DOCUMENTS

EP 1 202 209 4/2001

(Continued)

OTHER PUBLICATIONS

GB Search Report.

*Primary Examiner*—Robert P. Olszewski
*Assistant Examiner*—Aileen Chyn
(74) *Attorney, Agent, or Firm*—Milton L. Honig

(57) ABSTRACT

A diagnostic article and method is disclosed wherein the article includes a mirror, a plurality of attribute selection sites arranged along or associated with the mirror with each of the sites having a plurality of choice selectors, and an output for recommending at least one personal care product based upon input from the choice selectors. A diagnostic for skin includes attribute selection sites hosting questions related to a customer's age, skin coloration, dryness, sunburn susceptibility, pimple breakout affinity, wrinkle formation and pore size. Hair, dental and underarm products may also be personalized by the diagnostic system. The mirror allows a customer in-store to more accurately answer attribute questions through reference to the customer's mirror reflection.

31 Claims, 5 Drawing Sheets

U.S. PATENT DOCUMENTS

| | | | | |
|---|---|---|---|---|
| 2003/0065636 | A1* | 4/2003 | Peyrelevade | 706/62 |
| 2003/0222096 | A1* | 12/2003 | Kennedy et al. | 221/197 |
| 2005/0195316 | A1* | 9/2005 | Kollias et al. | 348/370 |
| 2005/0195972 | A1* | 9/2005 | Barr | 379/435 |

FOREIGN PATENT DOCUMENTS

| | | |
|---|---|---|
| EP | 1 240 845 | 3/2002 |
| GB | 1 290 824 | 9/1972 |
| JP | 11-244045 | 9/1999 |
| JP | 2002-224049 | 8/2002 |
| JP | 2002-291531 | 10/2002 |
| WO | 92/16928 | 10/1992 |
| WO | 01/18674 | 3/2001 |
| WO | 01/58238 | 8/2001 |
| WO | 01/91600 | 12/2001 |
| WO | 02/33628 | 4/2002 |

* cited by examiner

ARTICLE AND METHOD FOR SELECTION OF INDIVIDUALIZED PERSONAL CARE PRODUCTS

BACKGROUND OF THE INVENTION

1. Field of the Invention

The invention concerns an article and method whereby consumers can self-evaluate the most suitable personal care products for their body.

2. The Related Art

"Mirror mirror on the wall, who's the fairest of them all?". So inquired the wicked witch of the Snow White story. Were the witch to have had benefit of a personalized skin analysis, perhaps the recommended cosmetic treatment could have elevated her to be the fairest. Alas, she blindly selected her cosmetics without an understanding of those most suitable to her skin type.

Clinique® has for some years provided a slide rule type diagnosis system for in-store advice. Based on answers to certain questions, a customer is directed to the appropriate cosmetic product(s).

In-store product recommendation charts based on customer input have not been very successful. Some of the systems are complicated to operate and interpret. Other systems fail to attract attention. Better systems are necessary than heretofore known for providing an easy to operate, easy to understand and attention grabbing mechanism which can recommend personalized product(s).

SUMMARY OF THE INVENTION

A diagnostic article is provided which includes:

(i) a mirror;

(ii) a plurality of attribute selection sites arranged along or associated with the mirror, the sites each having a plurality of choice selectors; and (iii) an output for recommending at least one personal care product based upon input from the choice selectors.

Attribute selection sites for skin products may be those hosting questions related to a customer's age, skin coloration, dryness, sunburn susceptibility, pimple breakout affinity, wrinkle formation, pore size and combinations thereof. Advantageously, there can be from two to twenty but preferably from three to six choice selectors within each of a plurality of attribute selection sites. The sites may range in number from three to thirty, preferably from four to eight.

Activation of one of the selectors in a site will in preferred embodiments preclude concurrent activation of any other selector at that same site. Each of the choice selectors within a site may differ from another by representing a different degree of the attribute describing the site.

Selectors may be activated by finger pressure against an area designated by a writing as a selector site. Activation of a selector can initiate an electronic transmission signal to an electronic computer. Alternatively activation of a selector can initiate a mechanical transmission not connected to an electrical output. A low cost form of the output according to the present invention involves use of charts. This may be constructed of either paperboard or plastic. The chart may be a wheel identifying a plurality of personal care products at different locations on the wheel. Alternatively it may be a flip-chart of multiple pages or screens held together by a binder such as a loose-leaf ring.

A most important part of the present invention is that of a mirror which in several of the embodiments may be a two-way mirror. A plurality of personal care products, each identified by an icon (e.g. a pictorial or word mark) may be supported on a screen behind the mirror. A backlight behind the mirror is so arranged to selectively highlight one or more icons. The area of highlighting will relate to the product recommended through a questionnaire.

A still further alternative embodiment is where a membrane keypad is held behind the mirror. Entry of answers to the questionnaire are then indicated by pressing appropriate keys on the membrane keypad.

BRIEF DESCRIPTION OF THE DRAWING

Further features and advantages of the present invention will become more apparent by consideration of the following drawing in which.

DETAILED DESCRIPTION OF THE INVENTION

Now there has been found a diagnostic article and method which overcomes many of the disadvantages found with previously known ones. No longer is the diagnostic article lacking features of natural human attraction or forbiddingly uninviting. A mirror forms the central focus of the present invention. Humans are invariably attracted to a mirror. For some reason a person's own image is irresistible to view. Once the customer has been attracted to the display, the diagnostic array of questions comes to the customer's attention and is less daunting than a stand alone questionnaire/recommendation device.

Additionally, the mirror assists a customer in answering certain questions concerning their personal attributes. For instance, a question requesting identification of a person's skin tone becomes easier to answer. A series of different tones may be depicted on or directly adjacent to the mirror. The closest tone is much more easily identified through correlating the color of the face appearing in the mirror with one of the tones of the color array. Other attributes may also interact with feedback from a mirror image. Whether skin is oily or dry can be answered by viewing the mirror reflection.

Figure 1:
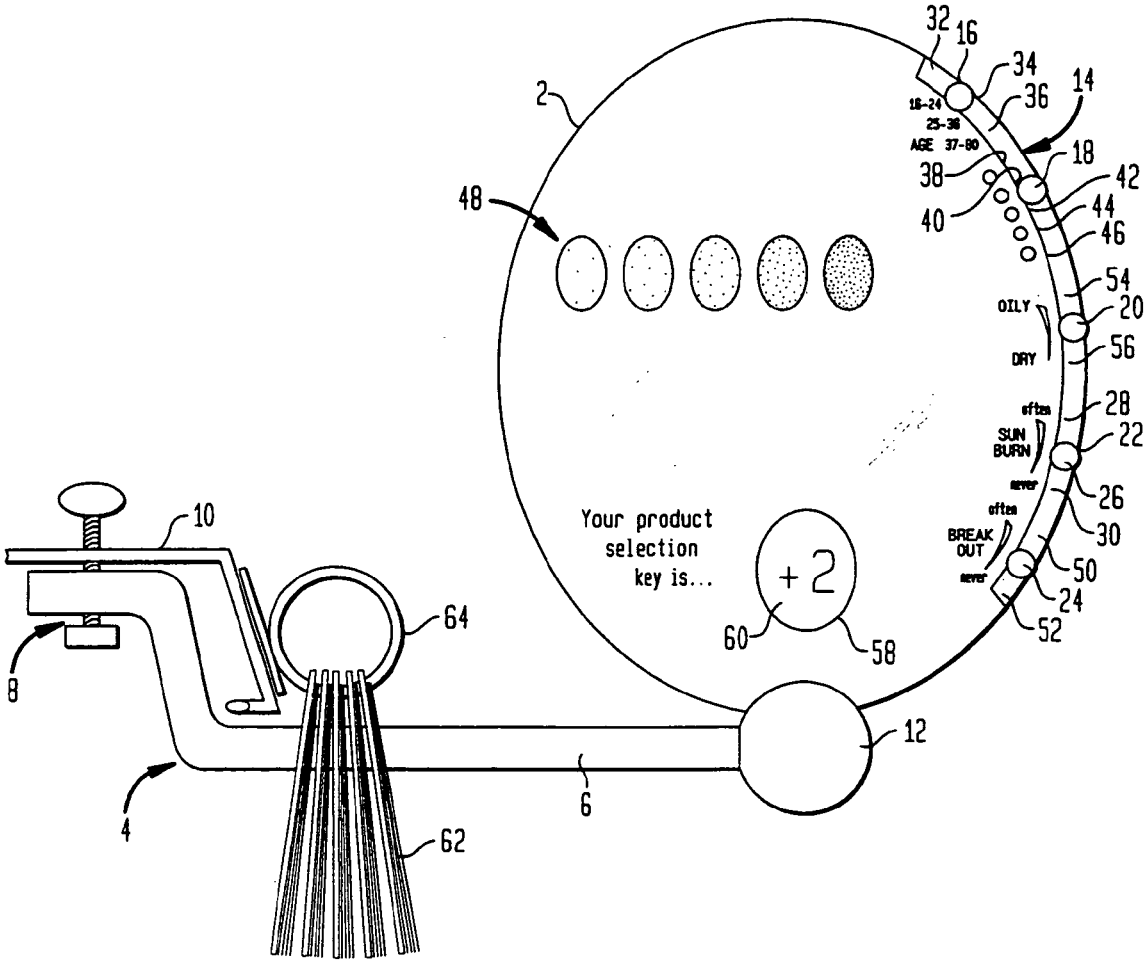
FIG. 1 is a mechanically operated first embodiment of the diagnostic article according to the present invention.

FIG. 1 illustrates a first embodiment of the present invention. A diagnostic article includes a mirror 2 attached to a support member 4. Elements of the support member include an arm 6 which at one end has an attachment member 8 in the form of a screwable bracket intended to be anchored onto a store shelf 10. Alternative support member embodiments would include a free-standing support base resting upon the shelf, a spring loaded clamp and an adhesive bond.

A connector member 12 is positioned at an opposite end of the arm distant from the attachment member and jutting outward beyond the shelf.

Figure 3:
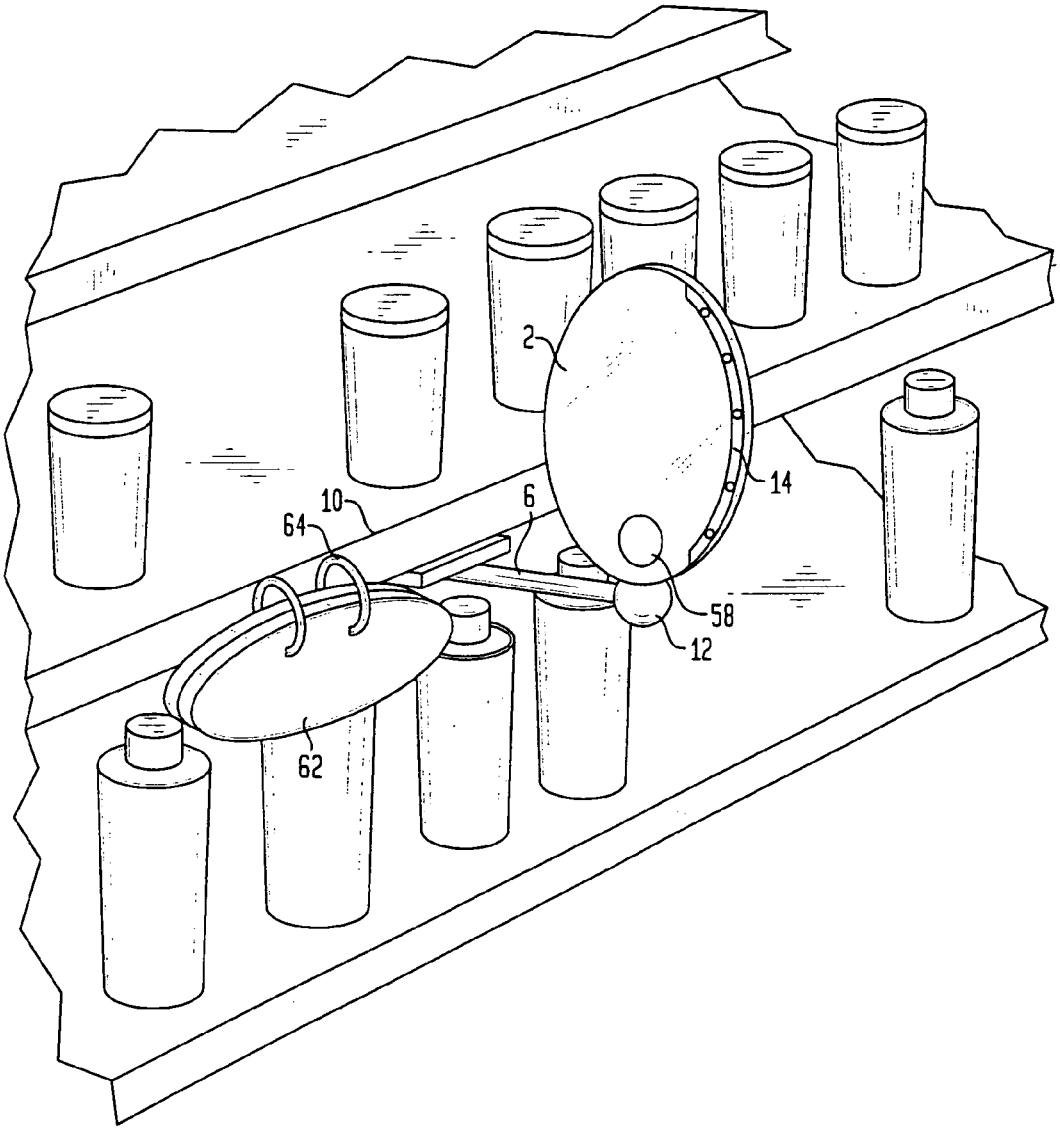
FIG. 3 is a perspective view of the first embodiment shown arranged on a store shelf.

FIG. 3 best illustrates the diagnostic article in the context of a store shelf adjacent a variety of cosmetic containers. The connector member may be movable or stationary and functioning to join the mirror to the support member. Moveability can be achieved by a ball-in-socket, spring clamp, ratchet, hinge or similar mechanism within the connector member.

The embodiment shown in FIG. 1 depicts five attribute selection sites along a selector track 14. These attribute selection sites include ones for age 16, color or tone 18, oiliness 20, sunburn susceptibility 22, and pimple breakout frequency 24.

A moveable lever 26 abuts each of the attribute selection sites. This lever can manually be manipulated to be placed adjacent one of the several choice selector positions. For instance, with respect to the sunburn susceptibility attribute selection site 22, there can be a choice between the "often" 28 and "never" 30 choice selector positions.

Another of the attribute selection sites relates to Age. There are choice selector positions along this site for the age groups "16–24", "25–36" and "37–80" seen in FIG. 1 as elements 32, 34 and 36.

Directly below is an attribute selection site for skin color or tone. A series of five shades of color or tone are presented at different choice selector positions 38, 40, 42, 44 and 46. An identical color or tone set 48 is arrayed in much larger form across a central face of the mirror. This enlarged set of color or tone on a prominent face of the mirror helps a customer match their skin as reflected in the mirror to one of the choice selector colors or tones. Guesswork is eliminated.

A fourth of the attribute selection sites is that for pimple breakout frequency. Along this question printed adjacent the mirror are two choice selector positions. These are for the answer "often" 50 or "never" 52. In some embodiments, there may be additional intermediate choice selector positions or a continuum of such positions.

The fifth of the attribute selection sites is that of oiliness 20. Here there may be choice selector positions of "oily" 54 and "dry" 56. There also may be several intermediate positions or a continuum of positions.

Upon a customer having arranged each of the movable levers to a choice selector position along the track, a mechanically operated pre-printed program board becomes oriented into a product selection window 58. In the embodiment of FIG. 1, the window is found at a lower section of the mirror. A key 60 appears within a window. The drawing illustrates the key as the number +2 which has been printed on the program board.

In its most particular form, the first embodiment involves an approximately 8 inch mirror. Each movable Lever 26 is interconnected along an 1×2.5 linkages which ultimately drive a wheel with the program board.

Figure 2:
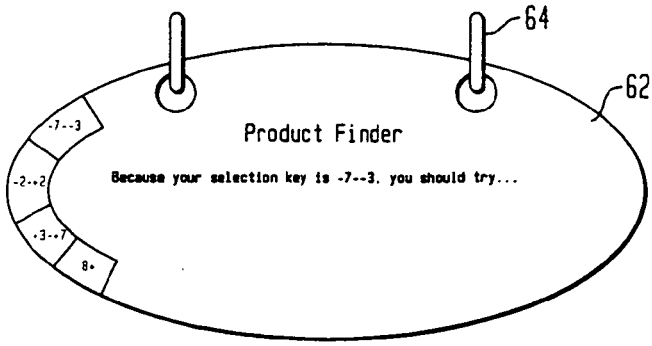
FIG. 2 is a product finder reference chart utilized in combination with the first embodiment.

The next step for a customer is to consult a product finder set of cards 62 held within a ring binder 64. FIG. 2 illustrates one embodiment of a typical card attached to the ring binder. Either in word reference or through a pictorial icon, the product finder card correlates the key identified from the mirror into particular personal care product(s) personalized to the customer. The ring binder with cards can be hung from the same shelf and even supported on the same attachment member as the mirror.

Figure 4:
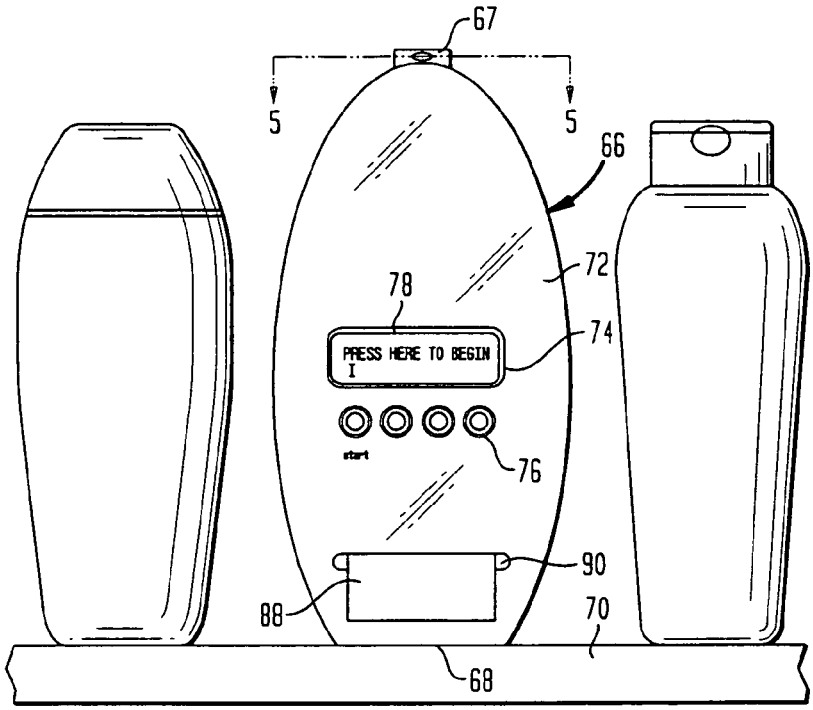
FIG. 4 is an electronically operated second embodiment of a diagnostic article according to the present invention.

A second embodiment of the present invention is best illustrated in FIG. 4. A housing 66 consolidates the diagnostic article within a single easily portable device. The housing has a flat bottom wall 68 capable of free-standing on a shelf 70. A front face of the housing is a mirror 72.

A window 74 and a series of choice selectors in the form of buttons 76 are formed on the front mirror face of the housing. An LCD screen 78 is displayed within window 74. Supported inside the housing is a program on a computer board 80.

A series of questions are stored in the program. These questions relate to personal questions such as age, skin coloration, dryness, sunburn susceptibility, pimple breakout affinity, wrinkles and pore sizes. When these appear within the window on the LCD screen, each question is considered an attribute selection site within the context of this invention. The customer is requested to answer each attribute question by pressing one of the four buttons 76. For instance, the screen may request the customer's age and list four choices such as "16+", "24+", "35+" and "50+", each positioned over one of the four buttons. Color or skin tone may be depicted on the LCD screen as a color icon or in words such as mocha, olive, light honey and ivory. The mirror helps the customer decide by viewing their own face and thereupon providing input to the questions.

Once a customer has answered all attribute questions, the program then calculates which is the best personal care product or set of products personalized to the customer.

Figure 5:
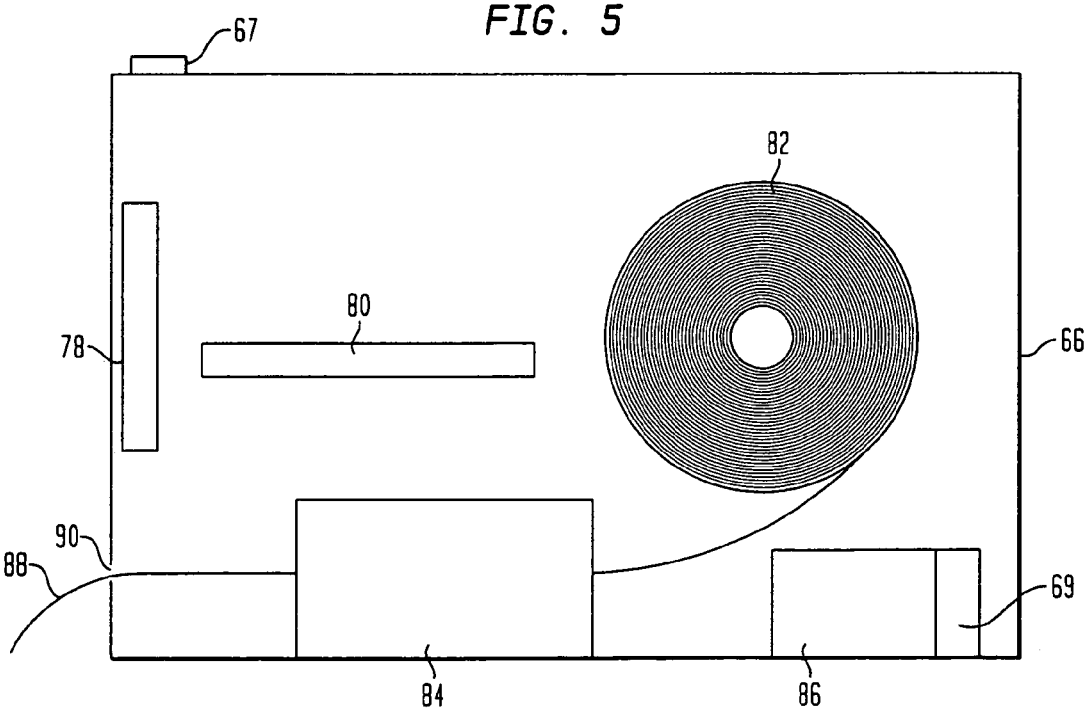
FIG. 5 is a schematic cross-sectional view of the internal mechanism taken along line 5—5 of the second embodiment shown in FIG. 4.

Alternatively or in addition to the LCD screen printout of best product set, a paper printout 88 can be provided describing the best product(s). FIG. 5 illustrates the printing mechanism. A paper roll 82 is supported within housing 66. Paper is fed from the roll to a printer 84. Power is generated by a battery unit 86. Printout 88 exits the housing through a slot 90. The customer can then tear off the printout from the paper roll and retain as a reminder or personal record.

Advantageously the diagnostic article according to the present invention may further include a camera 67 aligned with the mirror 72 for taking an image of the same customer face as mirror reflected. A still further optional aspect of the present invention is that of a wireless phone 69. This phone should be capable of transmitting to a distant central computer such as a central headquarters information provided by the customer. The phone connection will allow retransmission from the central location back to the diagnostic article and provide greater informational capability than would be available merely from the store diagnostic equipment.

Figure 6:
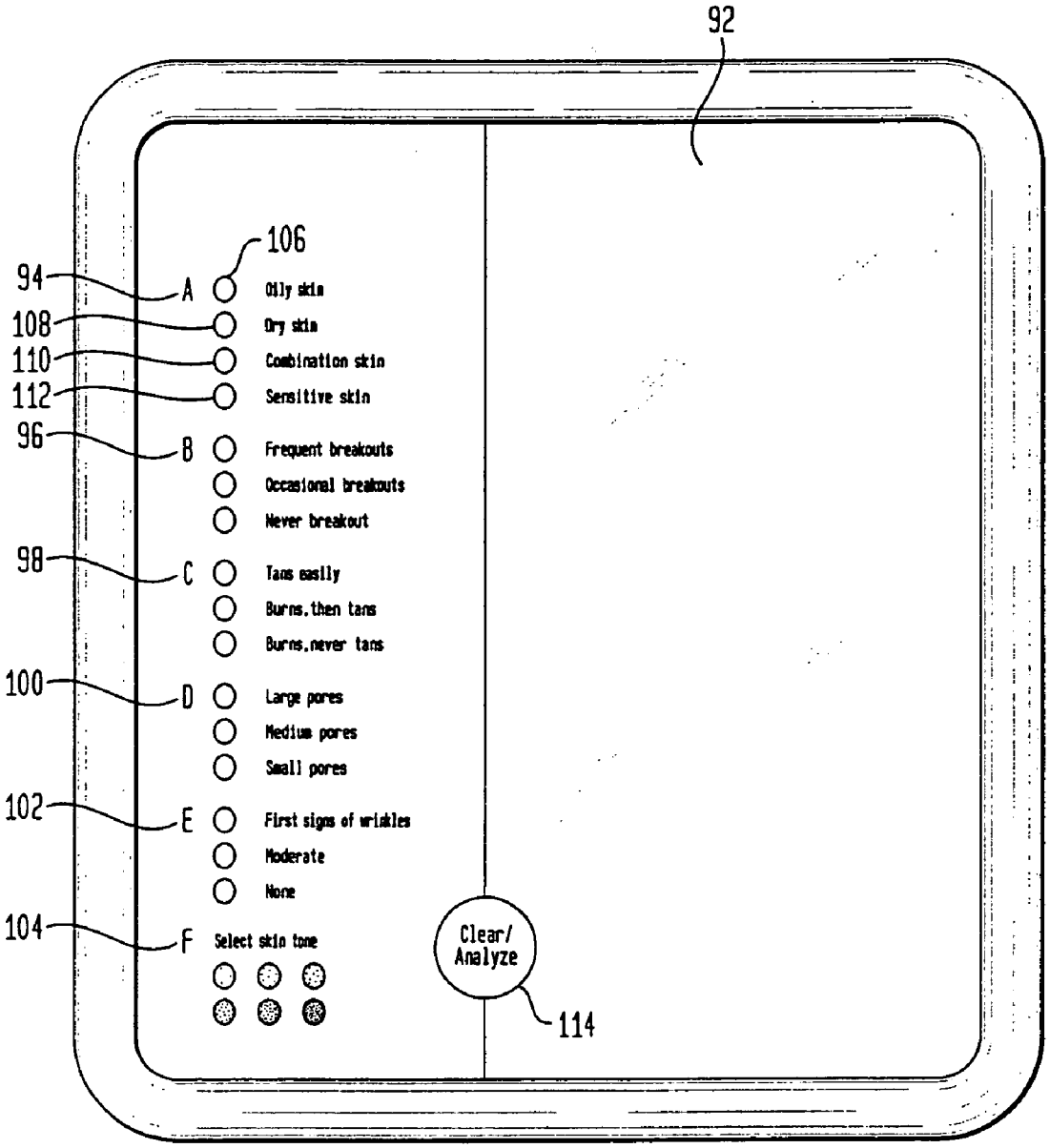
FIG. 6 is an electronically operated third embodiment of a diagnostic article according to the present invention.

FIG. 6 illustrates a third embodiment of the present invention. As with all other embodiments, a mirror 92 is the focus of attention. A series of six attribute selection sites 94–104 are arrayed in a column down a border of the mirror. These sites correspond to questions regarding dryness, pimple breakout affinity, sunburn susceptibility, pore size, wrinkles and skin coloration (and tone), respectively. The question posed for each attribute selection site has from three to six possible answers in the form of choice selector buttons. For instance, the skin dryness attribute site 94 has four possible choice selectors 106–112. These answers may range from oily skin, dry skin, combination skin and sensitive skin, respectively.

The skin coloration or tone attribute site 104 depicts the selection as six colored circles corresponding to a skin tone. Each of these choice selector colors represent an activatable button.

Once all of the questions have been answered by a customer applying finger pressure on an appropriate choice selector, the analyze button 114 is pressed. A pre-programmed computer then provides a recommendation to several personalized products that can be used in a skin care regime. This regime is tailored to the type of skin which the customer has described in their answer response.

Mirror 92 is a two-way mirror which underneath the buttons has a digital keypad for transmitting information to a miniaturized computer network. Anywhere from six to twenty-four regimes can be recommended. Within each regime are anywhere from one to six different types of products such as a toner, cleanser, moisturizer and/or conditioner. Color cosmetics may also be recommended and can include facial foundation, lipstick, mascara, blush, eyeliner and nail polish.

Icons depicting the recommended products are placed on transparencies 115 beneath the two-way mirror. The personalized set of products is presented as icons selectively backlighted so that their images shine through the two-way mirror.

Figure 7:
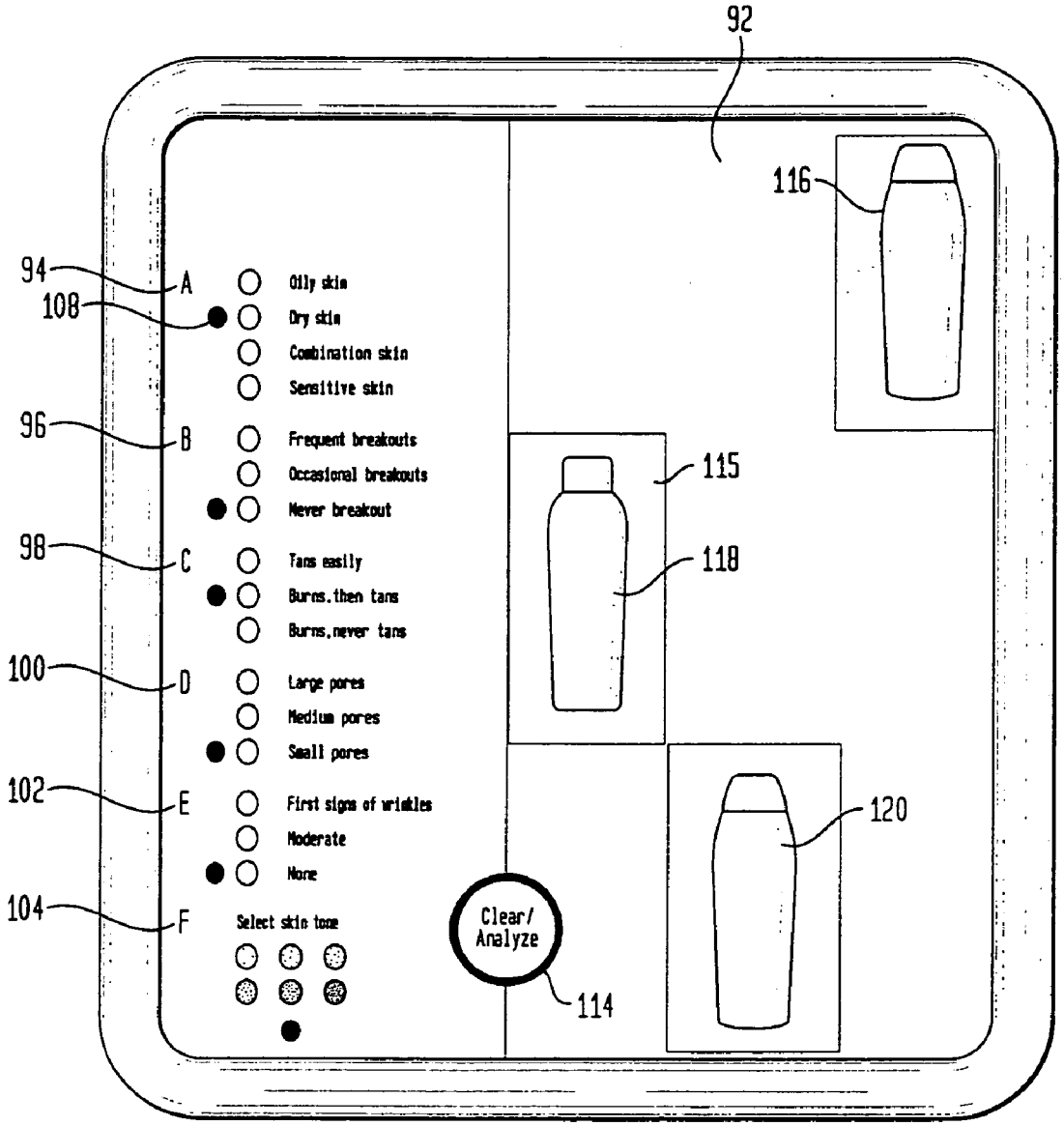
FIG. 7 is the third embodiment according to FIG. 6 which has been activated by customer input to reveal those personal care products most suitable for this particular customer.

FIG. 7 illustrates a backlighting sequence. One of each of the chosen choice selectors of the attribute selection sites is backlighted as well as the analyze button 114. This refreshes the customer's memory and confirms the selected answers to the questions along the attribute selection sites. Secondly, backlighting highlights three products suitable for the person pursuant to the questionnaire analysis. Backlighted depictions are presented of bottles for a facial cleanser 116, a body shower gel 118 and a conditioning lotion 120.

Variations of the third embodiment can also be practiced according to the present invention. For instance, the two-way mirror embodiment of FIGS. 6–7 can be provided with a membrane keypad underneath the mirror. Questions and a list of potential responses are viewable by scrolling up and down the mirror. The selector choices can be highlighted by an LCD tight. Based upon the individual choice selector response, a set of personal care products are then recommended. The recommendation is accomplished by triggering a color LCD image behind the two-way mirror. The image of a product bottle can then shine through the mirror. Those icons representing other (non-appropriate) products remain dark and therefore, non-visible to the customer.

Diagnostic articles according to the present invention are particularly suitable for skin but are not limited thereto. For instance, the device of this invention may be applicable to hair, underarm and oral products. Among questions necessary to probe for an appropriate personalized regime for hair treatment include those related to oiliness, color, dandruff susceptibility, age, curliness and thickness. Hair products can be recommended from categories including personalized conditioner, shampoo, styling aid, colorants and hair sprays.

Dental products can also be personalized with the diagnostic article of this invention. Questions that may be placed to a customer include teeth whiteness, number of cavities, breath freshness, taste, packaging type and combinations thereof. Use of the mirror is particularly effective to help customers match their teeth color in response to a question (s) regarding coloration. The mirrors also are useful to have a customer identify the number of cavities which may have been previously filled.

The term "comprising" is meant not to be limiting to any subsequently stated elements but rather to encompass non-specified elements of major or minor functional importance. In other words the listed steps, elements or options need not be exhaustive. Whenever the words "including" or "having" are used, these terms are meant to be equivalent to "comprising" as defined above.

The invention claimed is:

1. A diagnostic article comprising:

(i) a two-way mirror;

(ii) a plurality of attribute selection sites arranged along or associated with the mirror, the sites each having a plurality of choice selectors, the sites being areas hosting questions related to those selected from the group consisting of age, skin coloration, dryness, sunburn susceptibility, pimple breakout affinity, wrinkles, pore sizes and combinations thereof; and (iii) an output for recommending at least one personal care product based upon input from the choice selectors, and wherein the at least one personal care product is identified by icon, pictorial or trademark on a support behind the mirror.

2. The article according to claim 1 wherein a plurality of the sites have at least three choice selectors.

3. The article according to claim 1 wherein activation of one of the choice selectors in a site precludes concurrent activation of any other selector at that same site.

4. The article according to claim 1 wherein each of the choice selectors within a site differ from one another by representing a different degree of an attribute describing the site.

5. The article according to claim 1 wherein a choice selector is activated by finger pressure against an area designated as a selector site.

6. The article according to claim 1 wherein activation of a choice selector initiates an electronic transmission signal to a computer program.

7. The article according to claim 1 wherein activation of a choice selector initiates a mechanical transmission not connected to an electronic computer.

8. The article according to claim 1 wherein the output is detailed on one or more charts which recommend one or more personal care products most suitable to a customer.

9. The article according to claim 1 further comprising a backlight behind the mirror arranged to selectively highlight the icon, pictorial or trademark.

10. The article according to claim 1 further comprising a membrane keypad behind the mirror.

11. The article according to claim 1 further comprising a camera aligned with the mirror focusing on a customer whose image is reflected in the mirror.

12. The article according to claim 1 further comprising a wireless phone transmitting information processed from input from the choice selectors and the information being transmitted to a distant computer.

13. The article according to claim 1 further comprising an array of similarly sized areas each with a different color shade arranged on the mirror for helping to find a color match with that of a facial image reflected in the mirror.

14. The article according to claim 1 further comprising a support member comprising an arm for supporting the mirror and at one end having an attachment member capable of being anchored onto a store shelf and also jutting outward from the shelf.

15. A method for recommending a skin care product to a customer comprising:

(A) providing a diagnostic article comprising:

(i) a two-way mirror;

(ii) a plurality of attribute selection sites arranged along or associated with the mirror, the sites each having a plurality of choice selectors, the sites being areas hosting questions related to those selected from the group consisting of age, skin coloration, dryness, sunburn susceptibility, pimple breakout affinity, wrinkles, pore sizes and combinations thereof; and (iii) an output for recommending at least one skin care product based upon input from the choice selectors;

(B) instructing a customer to actuate one of the plurality of choice selectors for each of the attribute selection sites thereby answering questions related to personal attributes of the customer; and (C) recommending to the customer one or more skin care products based upon their input from the choice selectors, and wherein the at least one skin care product is identified by icon, pictorial or trademark on a support behind the mirror.

16. The method according to claim 15 wherein step (A) further comprises attaching the diagnostic article to a shelf in a store and positioning the article to jut outward beyond the shelf, the article further comprising a support member with an arm having one end anchored onto the shelf and another end supporting the mirror.

17. A diagnostic article comprising:

(i) a mirror and a membrane keypad behind the mirror;

(ii) a plurality of attribute selection sites arranged along or associated with the mirror, the sites each having a plurality of choice selectors, the sites being areas hosting questions related to those selected from the group consisting of age, skin coloration, dryness, sunburn susceptibility, pimple breakout affinity, wrinkles, pore sizes and combinations thereof; and (iii) an output for recommending at least one personal care product based upon input from the choice selectors, and wherein the at least one personal care product is identified by icon, pictorial or trademark on a support behind the mirror.

18. The article according to claim 17 wherein a plurality of the sites have at least three choice selectors.

19. The article according to claim 17 wherein activation of one of the choice selectors in a site precludes concurrent activation of any other selector at that same site.

20. The article according to claim 17 wherein each of the choice selectors within a site differ from one another by representing a different degree of an attribute describing the site.

21. The article according to claim 17 wherein a choice selector is activated by finger pressure against an area designated as a selector site.

22. The article according to claim 17 wherein activation of a choice selector initiates an electronic transmission signal to a computer program.

23. The article according to claim 17 wherein activation of a choice selector initiates a mechanical transmission not connected to an electronic computer.

24. The article according to claim 17 wherein the output is detailed on one or more charts which recommend one or more personal care products most suitable to a customer.

25. The article according to claim 17 further comprising a backlight behind the mirror arranged to selectively highlight the icon, pictorial or trademark.

26. The article according to claim 17 wherein the attribute selection sites are areas hosting hair related questions selected from the group consisting of oiliness, color, dandruff susceptibility, age, curliness, thickness and combinations thereof.

27. The article according to claim 17 wherein the attribute selection sites are areas hosting dental questions related to those selected from the group consisting of teeth whiteness, number of cavities, breath freshness, taste, packaging and combinations thereof.

28. The article according to claim 17 further comprising a camera aligned with the mirror focusing on a customer whose image is reflected in the mirror.

29. The article according to claim 17 further comprising a wireless phone transmitting information processed from input from the choice selectors and the information being transmitted to a distant computer.

30. The article according to claim 17 further comprising an array of similarly sized areas each with a different color shade arranged on the mirror for helping to find a color match with that of a facial image reflected in the mirror.

31. The article according to claim 17 further comprising a support member comprising an arm for supporting the mirror and at one end having an attachment member capable of being anchored onto a store shelf and also jutting outward from the shelf.

* * * * *